US008210257B2

(12) United States Patent
Dusterhoft et al.

(10) Patent No.: US 8,210,257 B2
(45) Date of Patent: Jul. 3, 2012

(54) FRACTURING A STRESS-ALTERED SUBTERRANEAN FORMATION

(75) Inventors: Ronald Glen Dusterhoft, Katy, TX (US); Loyd Eddie East, Tomball, TX (US); Mohamed Y. Soliman, Cypress, TX (US)

(73) Assignee: Halliburton Energy Services Inc., Duncan, OK (US)

( * ) Notice: Subject to any disclaimer, the term of this patent is extended or adjusted under 35 U.S.C. 154(b) by 271 days.

(21) Appl. No.: 12/715,226

(22) Filed: Mar. 1, 2010

(65) Prior Publication Data

US 2011/0209868 A1 Sep. 1, 2011

(51) Int. Cl.

| | |
|---|---|
| ***E21B 43/26*** | (2006.01) |
| ***E21B 47/12*** | (2012.01) |
| ***E21B 49/00*** | (2006.01) |

(52) U.S. Cl. ..... 166/250.1; 166/72; 166/272.2; 166/308.1

(58) Field of Classification Search ..... None
See application file for complete search history.

(56) References Cited

U.S. PATENT DOCUMENTS

| | | | |
|---|---|---|---|
| 4,797,821 | A | 1/1989 | Petak et al. |
| 4,828,028 | A | 5/1989 | Soliman |
| 4,836,280 | A | 6/1989 | Soliman |
| 5,005,643 | A | 4/1991 | Soliman et al. |
| 5,050,674 | A | 9/1991 | Soliman et al. |
| 5,111,881 | A | 5/1992 | Soliman et al. |
| 5,558,161 | A | 9/1996 | Vitthal et al. |
| 6,070,664 | A | 6/2000 | Dalrymple et al. |
| 6,470,970 | B1 | 10/2002 | Purkis et al. |
| 6,481,494 | B1 | 11/2002 | Dusterhoft et al. |
| 6,540,022 | B2 | 4/2003 | Dusterhoft et al. |
| 6,575,237 | B2 | 6/2003 | Purkis et al. |
| 6,585,051 | B2 | 7/2003 | Purkis et al. |
| 6,659,184 | B1 | 12/2003 | Tips et al. |
| 6,702,019 | B2 | 3/2004 | Dusterhoft et al. |
| 6,772,837 | B2 | 8/2004 | Dusterhoft et al. |
| 6,776,238 | B2 | 8/2004 | Dusterhoft et al. |
| 6,795,773 | B2 | 9/2004 | Soliman et al. |
| 6,907,936 | B2 | 6/2005 | Fehr et al. |
| 6,995,683 | B2 | 2/2006 | Smithson et al. |
| 7,013,980 | B2 | 3/2006 | Purkis et al. |

(Continued)

OTHER PUBLICATIONS

"*New Approach for Real Time Analysis of Fracturing Data*", IP.Com Prior Art Database, Nov. 30, 2009, 9 pages.

(Continued)

*Primary Examiner* — Zakiya W Bates
(74) *Attorney, Agent, or Firm* — Robert A. Kent; Fish & Richardson, P.C.

(57) ABSTRACT

A well bore in a subterranean formation includes a signaling subsystem communicably coupled to injection tools installed in the well bore. Each injection tool controls a flow of fluid into an interval of the formation based on a state of the injection tool. Stresses in the subterranean formation are altered by creating fractures in the formation. Control signals are sent from the well bore surface through the signaling subsystem to the injection tools to modify the states of one or more of the injection tools. Fluid is injected into the stress-altered subterranean formation through the injection tools to create a fracture network in the subterranean formation. In some implementations, the state of each injection tool can be selectively and repeatedly manipulated based on signals transmitted from the well bore surface. In some implementations, stresses are modified and/or the fracture network is created along a substantial portion and/or the entire length of a horizontal well bore.

20 Claims, 5 Drawing Sheets

U.S. PATENT DOCUMENTS

| | | | | |
|---|---|---|---|---|
| 7,021,384 | B2 | 4/2006 | Themig | |
| 7,025,134 | B2 | 4/2006 | Byrd et al. | |
| 7,090,153 | B2 | 8/2006 | King et al. | |
| 7,108,067 | B2 | 9/2006 | Themig et al. | |
| 7,108,083 | B2 | 9/2006 | Simonds et al. | |
| 7,114,560 | B2 | 10/2006 | Nguyen et al. | |
| 7,134,505 | B2 | 11/2006 | Fehr et al. | |
| 7,145,471 | B2 | 12/2006 | Purkis et al. | |
| 7,210,856 | B2 | 5/2007 | Ringgenberg | |
| 7,225,869 | B2 | 6/2007 | Willett et al. | |
| 7,228,908 | B2 | 6/2007 | East, Jr. et al. | |
| 7,240,737 | B2 | 7/2007 | Tips | |
| 7,273,099 | B2 | 9/2007 | East, Jr. et al. | |
| 7,325,597 | B2 | 2/2008 | Ringgenberg et al. | |
| 7,343,975 | B2 | 3/2008 | Surjaatmadja et al. | |
| 7,353,878 | B2 | 4/2008 | Themig | |
| 7,357,021 | B2 | 4/2008 | Blacklaw | |
| 7,431,090 | B2 | 10/2008 | Surjaatmadja et al. | |
| 7,431,091 | B2 | 10/2008 | Themig et al. | |
| 7,445,045 | B2 | 11/2008 | East, Jr. et al. | |
| 7,458,273 | B2 | 12/2008 | Skinner et al. | |
| 7,478,676 | B2 | 1/2009 | East, Jr. et al. | |
| 7,484,566 | B2 | 2/2009 | Tips et al. | |
| 7,503,385 | B2 | 3/2009 | Tips et al. | |
| 7,543,634 | B2 | 6/2009 | Fehr et al. | |
| 7,543,635 | B2 | 6/2009 | East et al. | |
| 7,575,062 | B2 | 8/2009 | East, Jr. | |
| 7,580,796 | B2 | 8/2009 | Soliman et al. | |
| 7,647,183 | B2 | 1/2010 | Jechumtalova et al. | |
| 7,660,194 | B2 | 2/2010 | Uhl et al. | |
| 7,660,199 | B2 | 2/2010 | Drew | |
| 2006/0118301 | A1 | 6/2006 | East, Jr. et al. | |
| 2006/0155473 | A1 | 7/2006 | Soliman et al. | |
| 2006/0201674 | A1 | 9/2006 | Soliman et al. | |
| 2007/0272407 | A1 | 11/2007 | Lehman et al. | |
| 2008/0083538 | A1 | 4/2008 | Soliman | |
| 2009/0125280 | A1 | 5/2009 | Soliman et al. | |
| 2009/0194273 | A1 * | 8/2009 | Surjaatmadja et al. | .... 166/250.1 |
| 2011/0125476 | A1 * | 5/2011 | Craig | ..... 703/10 |

OTHER PUBLICATIONS

StackFRAC® HD High Density Multi-Stage Fracturing System, Packers Plus Energy Services, Inc., Sep. 2009, 2 pages.

StimMAP Direct measurement of hydraulic fracture geometry, copyright 2008 Schlumberger, 2 pages.

Soliman, M.Y., et al. "*Fracturing Design aimed at Enhancing Fracture Complexity*" SPE 130043, Abstract submitted to Society of Petroleum Engineers on or about Sep. 1, 2009, copyright 2010, 20 pages.

Soliman, M.Y., et al. "*Geomechanics Aspects of Multiple Fracturing of Horizontal and Vertical Wells*," SPE 86992, copyright 2008, Society of Petroleum Engineers, Sep. 2008 SPE Drilling and Completion, pp. 217-228.

sFrac™ Valve, Well Dynamics, Transforming Reservoirs™ Jul. 2008, 4 pages.

Pinpoint Multistate Fracturing Using a Unique Bridge Plug and Hydrajet Perforating (CobraElite® Service), copyright 2009 Halliburton; 2 pages.

Cobra Frac® Service, copyright 2005 Halliburton, 2 pages.

CobraJet Frac® Service, copyright 2006 Halliburton; 2 pages.

SurgiFrac$^{SM}$ Service, copyright 2005 Halliburton; 2 pages.

CobraMax$^{SM}$ Fracturing Service, copyright 2005 Halliburton; 2 pages.

Delta Stim® Completion Service, copyright 2008 Halliburton; 4 pages.

Delta Stim® Sleeve, copyright 2008 Halliburton; 4 pages.

Delta Stim® Initiator, copyright 2009 Halliburton; 2 pages.

FO™ Multiple-Stage Cementing System, copyright 2009 Halliburton; 2 pages.

Delta Stim® Lite Sleeve, copyright 2009 Halliburton; 2 pages.

Stimulation for the Digital Asset™ Workflow, copyright 2009 Halliburton; 2 pages.

Dodds, Rich, "Digital Asset Work Flows: Changing the Way We Work," The Digital Oil Field, Jul. 2009, 2 pages.

Geosteering for the Digital Asset™ Workflow, copyright 2009 Halliburton; 2 pages.

Delta Stim$^{SM}$ Completion Service, Top Technology Solutions 2008, copyright 2008 Halliburton; 2 pages.

U.S. Appl. No. 12/566,467, filed Sep. 24, 2009, entitled "Method for Inducing Fracture Complexity in Hydraulically Fractured Horizontal Well Completions," inventors East, Jr., Soliman, and Augustine.

* cited by examiner

FRACTURING A STRESS-ALTERED SUBTERRANEAN FORMATION

BACKGROUND

Oil and gas wells produce oil, gas and/or byproducts from subterranean formations. Some formations, such as shale formations, coal formations, and other tight gas formations containing natural gas, have extremely low permeability. The formation's ability to conduct resources may be increased by fracturing the formation. During a hydraulic fracture treatment, fluids are pumped under high pressure into a rock formation through a well bore to artificially fracture the formation and increase permeability and production of resources from the formation. Fracture treatments as well as production and other activities can cause complex fracture patterns to develop in the formation. Complex-fracture patterns can include complex networks of fractures that extend to the well bore, along multiple azimuths, in multiple different planes and directions, along discontinuities in rock, and in multiple regions of a reservoir.

SUMMARY

Systems, methods, include operations related to fracturing a stress-altered subterranean formation. In one general aspect, a fracture system that applies the fracture treatment to the stress-altered formation is reconfigured based on signals transmitted from a well bore surface.

In one aspect, injection tools and a signaling subsystem are installed in a well bore in a subterranean formation. Each of the injection tools controls fluid flow from the well bore into the subterranean formation based on a state of the injection tool. The signaling subsystem transmits control signals from a well bore surface to each injection tool to change the state of the injection tool. The injection tools include a first, second, third, and possibly more injection tools. The first injection tool and the third injection tool are used to form a first fracture and a third fracture in the subterranean formation, and forming the first and third fractures alters a stress anisotropy in a zone between the first and third fractures. The signaling subsystem is used to change the states of at least one of the injection tools by transmitting control signals from the well bore surface after formation of the first and third fractures. The second injection tool is used to form a fracture network in the zone having the altered stress anisotropy between the first and third fractures.

Implementations may include one or more of the following features. Properties of the subterranean formation are measured while using the second injection tool to form the fracture network. The signaling subsystem is used to change the states of at least one of the injection tools by transmitting additional control signals from the well bore surface while using the second injection tool to form the fracture network. The additional control signals are based on the measured properties. Each of the injection tools includes an injection valve that controls the fluid flow from the well bore into the subterranean formation. Using the signaling subsystem to change the states of the injection tools includes selectively opening or closing at least one of the valves without well intervention. Selectively opening or closing the valves includes closing a valve of the first injection tool after formation of the first fracture, closing a valve of the third injection tool after formation of the third fracture, and opening a valve of the second injection tool. Using the first and third injection tools to form the first and third fractures includes simultaneously forming the first and third fractures. The signaling subsystem includes hydraulic control lines. The control signals are hydraulic control signals transmitted from the well bore surface. The signaling subsystem includes electrical control lines. The control signals include electronic control signals transmitted from the well bore surface. The injection tools are installed in a horizontal well bore. The zone having the altered stress anisotropy resides laterally between the first fracture and the third fracture. The subterranean formation includes a tight gas reservoir.

In one aspect, a system for fracturing a subterranean formation includes a well bore in the subterranean formation, injection tools installed in the well bore, and an injection control subsystem. Each injection tool controls a flow of fluid from the well bore into an interval of the subterranean formation based on a state of the injection tool. A first injection tool controls a first flow of fluid into a first interval, a second injection tool controls a second flow of fluid into a second interval, and a third injection tool controls a third flow of fluid into a third interval. The second injection tool is installed in the well bore between the first injection tool and the third injection tool. The injection control subsystem controls the states of the injection tools by sending control signals from the well bore surface to the injection tools through a signaling subsystem installed in the well bore. Each of the control signals changes the state of one of the injection tools to modify the flow controlled by the injection tool. The subterranean formation includes a zone of altered stress anisotropy, where the stress anisotropy of the zone has been altered by the first flow of fluid into the first interval and the third flow of fluid into the third interval. The subterranean formation includes a fracture network in the zone of altered stress anisotropy. The fracture network is formed by the second flow of fluid into the second interval.

Implementations may include one or more of the following features. The system further includes a data analysis subsystem that identifies properties of the subterranean formation based on data received from a measurement subsystem during a fracture treatment. The control signals transmitted during the fracture treatment are based on the properties identified by the data analysis subsystem. The measurement subsystem includes microseismic sensors that detect microseismic events in the subterranean formation. The data analysis subsystem includes a fracture mapping subsystem that identifies locations of fractures in the subterranean formation based on data received from the microseismic sensors. The measurement subsystem includes tiltmeters installed at surfaces about the subterranean formation to detect orientations of the surfaces. The data analysis subsystem includes a fracture mapping subsystem that identifies locations of fractures in the subterranean formation based on data received from the tiltmeters. The measurement subsystem includes pressure sensors that detect pressures of fluids in the well bore. The data analysis subsystem includes a pressure interpretation subsystem that identifies properties of fluid flow in the subterranean formation based on data received from the pressure sensors.

In one aspect, stresses in a subterranean formation adjacent a well bore are altered by creating a plurality of fractures in the subterranean formation along the well bore. Control signals are sent from a well bore surface through a signaling subsystem to injection tools installed in the well bore to select a sequence of states for the injection tools. Fluid is injected into the stress-altered subterranean formation through the injection tools in each of the states to create a fracture network in the subterranean formation.

Implementations may include one or more of the following features. The well bore is a horizontal well bore. The sequence of states includes a first state and multiple additional states after the first state. One or more of the additional states is based on data received from the subterranean formation during the injection of fluid through the injection tools in the first state. Altering stresses in the subterranean formation includes injecting fluid from the well bore into a first interval of the subterranean formation through a first injection tool and injecting fluid from the well bore into a third interval of the subterranean formation through a third injection tool. Selecting a first state of the plurality of sequential states includes closing the first injection tool based on a first control signal transmitted from the well bore surface through the signaling subsystem, closing the third injection tool based on a third control signal transmitted from the well bore surface through the signaling subsystem, and/or opening a second injection tool based on a second control signal transmitted from the well bore surface through the signaling subsystem. Injecting fluid into the stress-altered subterranean formation includes injecting fluid from the well bore into a second interval of the subterranean formation through the second injection tool to fracture the second interval. The second interval resides between the first interval and the third interval. Injecting fluid into the first interval and injecting fluid into the third interval includes simultaneously injecting fluid into the first interval and the third interval. Selecting a second state of the sequential states includes opening at least one additional injection tool installed in the well bore based on a fourth signal transmitted from the well bore surface through the signaling subsystem during the injection through the second injection tool. The at least one additional injection tool may include the first injection tool, the third injection tool, and/or a fourth injection tool. Selecting a third state of the sequential states includes closing the at least one additional injection tool based on a fifth signal transmitted from the well bore surface through the signaling subsystem during the injection through the second injection tool.

The details of one or more embodiments of these concepts are set forth in the accompanying drawings and the description below. Other features, objects, and advantages of these concepts will be apparent from the description and drawings, and from the claims.

DESCRIPTION OF DRAWINGS

Like reference symbols in the various drawings indicate like elements.

DETAILED DESCRIPTION

Figure 1:
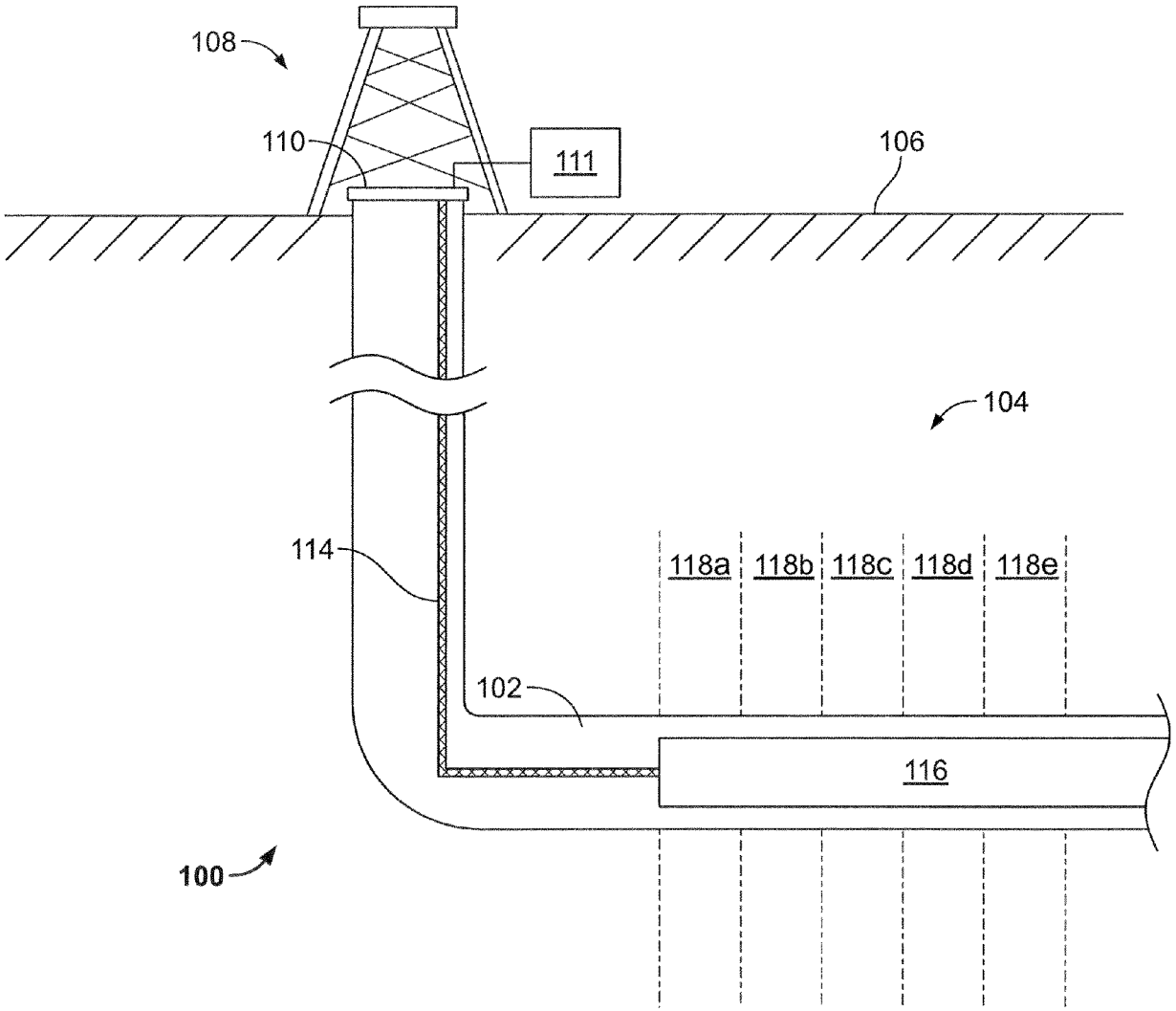
FIG. 1 is a diagram of an example well system for fracturing a subterranean formation.

FIG. 1 is a diagram of an example well system 100 for fracturing a subterranean formation. The example well system 100 includes a well bore 102 in a subterranean region 104 beneath the surface 106. The example well bore 102 shown in FIG. 1 includes a horizontal well bore. However, a well system may include any combination of horizontal, vertical, slant, curved, and/or other well bore orientations. The subterranean region 104 may include a reservoir that contains hydrocarbon resources, such as oil, natural gas, and/or others. For example, the subterranean region 104 may include a formation (e.g., shale, coal, sandstone, granite, and/or others) that contain natural gas. The subterranean region 104 may include naturally fractured rock and/or natural rock formations that are not fractured to any significant degree. The subterranean region 104 may include tight gas formations that include low permeability rock (e.g., shale, coal, and/or others).

The example well system 100 includes a fluid injection system 108. The fluid injection system 108 can be used to perform an injection treatment, whereby fluid is injected into the subterranean region 104 from the well bore 102. For example, the injection treatment may fracture rock and/or other materials in the subterranean region 104. In such examples, fracturing the rock may increase the surface area of the formation, which may increase the rate at which the formation conducts fluid resources to the well bore 102. The injection system 108 may utilize selective fracture valve control, information on stress fields around hydraulic fractures, real time fracture mapping, real time fracturing pressure interpretation, and/or other techniques to achieve desirable complex fracture geometries in the subterranean region 104.

The example injection system 108 includes an injection control subsystem 111, a signaling subsystem 114 installed in the well bore 102, and one or more injection tools 116 installed in the well bore 102. The injection control subsystem 111 can communicate with the injection tools 116 from the well bore surface 110 via the signaling subsystem 114. The injection system 108 may include additional and/or different features not shown in FIG. 1. For example, the injection system 108 may include features described with respect to FIGS. 2, 3, and 4, and/or other features. In some implementations, the injection system 108 includes computing subsystems, communication subsystems, pumping subsystems, monitoring subsystems, and/or other features.

The example injection system 108 delineates multiple injection intervals 118*a*, 118*b*, 118*c*, 118*d*, and 118*e* (collectively "intervals 118") in the subterranean region 104. The injection tools 116 may include multiple injection valves that inject fluid into each of the intervals 118. The boundaries of the intervals 118 may be delineated by the locations of packers and/or other types of equipment in the well bore 102 and/or by features of the subterranean region 104. The injection system 108 may delineate fewer intervals and/or multiple additional intervals beyond the five example intervals 118 shown in FIG. 1. The intervals 118 may each have different widths, or the intervals may be uniformly distributed along the well bore 102. In some implementations, the injection tools 116 are installed through substantially the entire length of the horizontal well bore and communicate fluid into intervals 118 along substantially the entire length of the horizontal well bore. In some implementations, the injection tools 116 are installed in, and communicate fluid into intervals 118 along, a limited portion of the well bore.

The injection tools 116 may include multiple down hole fracture valves that are used to perform an injection treatment. In some implementations, multiple fracture valves of the injection tools 116 are controlled in real time or near real time from the surface, which allows fluid to be injected into selected intervals of the subterranean region 104 at any given time during the fracturing treatment. In some cases, the injection system 108 injects fluid simultaneously in multiple intervals and then, based on information gathered from fracture mapping and pressure interpretation during the injection, the system 108 reconfigures the injection tools 116 to modify the manner in which fluid is injected and/or to help facilitate complex fracture growth. For example, microseismic equipment, tiltmeters, pressure meters and/or other equipment can monitor the extent of fracture growth and complexity continuously during operations. In some implementations, fracture mapping based on the collected data can be used to determine when and in what manner to reconfigure down hole injection valves to achieve desired fracture properties. Reconfiguring the injection tools 116 may include opening, closing, restricting, dilating, and/or otherwise manipulating one or more flow paths of the fracture valves.

The injection system 108 may alter stresses in the subterranean region 104 along a substantial portion of the horizontal well bore (e.g., the entire length of the well bore or less than the entire length). For example, the injection system 108 may alter stresses in the subterranean region 104 by performing an injection treatment in which fluid can be injected into the formation through any combination of one or more valves of the injection tools 116, along some or all of the length of the well bore 102. In some cases, the combination of injection valves used for the injection treatment can be modified at any given time during the injection treatment. For example, the sequence of valve configurations can be predetermined as part of a treatment plan, selected in real time based on feedback, or a combination of these. The injection treatment may alter stress by creating a multitude of fractures along a substantial portion of the horizontal well bore (e.g., the entire length of the well bore or less than the entire length).

The injection system 108 may create or modify a complex fracture network in the subterranean region 104 by injecting fluid into portions of the subterranean region 104 where stress has been altered. For example, the complex fracture network may be created or modified after an initial injection treatment has altered stress by fracturing the subterranean region 104 at multiple locations along the well bore 102. After the initial injection treatment alters stresses in the subterranean formation, one or more valves of the injection tools 116 may be selectively opened or otherwise reconfigured to stimulate or re-stimulate specific intervals of the subterranean region 104, taking advantage of the altered stress state to create complex fracture networks.

The technique of performing an initial injection treatment to alter stress and then injecting fluid into the altered-stress zone to create or modify a fracture network can be repeated along the entire length or any selected portion of the wellbore. In some implementations, individual injection valves of the injection tools 116 are reconfigured (e.g., opened, closed, restricted, dilated, or otherwise manipulated) multiple times during such injection treatments. For example, an injection valve that communicates fluid into the subterranean region 104 may be reconfigured multiple times during the injection treatment based on signals transmitted from the well bore surface 110 through the signaling subsystem 114. In some implementations, sensing equipment (e.g., tiltmeters, geophones, micro seismic detecting devices, etc.) collect data from the subterranean region 104 before, during, and/or after an injection treatment. The data collected by the sensing equipment can be used to help determine where to inject (i.e., what injection valve to use, where to position an injection valve, etc.) and/or other properties of an injection treatment (e.g., flow rate, flow volume, etc.) to achieve desired fracture network properties.

The example injection control subsystem 111 shown in FIG. 1 controls operation of the injection system 108. The injection control subsystem 111 may include data processing equipment, communication equipment, and/or other systems that control injection treatments applied to the subterranean region 104 through the well bore 102. The injection control subsystem 111 may receive, generate and/or modify an injection treatment plan that specifies properties of an injection treatment to be applied to the subterranean region 104. The injection control subsystem 111 may initiate control signals that configure the injection tools 116 and/or other equipment (e.g., pump trucks, etc.) to execute aspects of the injection treatment plan. The injection control subsystem 111 may receive data collected from the subterranean region 104 and/or another subterranean region by sensing equipment, and the injection control subsystem 111 may process the data and/or otherwise use the data to select and/or modify properties of an injection treatment to be applied to the subterranean region 104. The injection control subsystem 111 may initiate control signals that configure and/or reconfigure the injection tools 116 and/or other equipment based on selected and/or modified properties.

The example signaling subsystem 114 shown in FIG. 1 transmits signals from the well bore surface 110 to one or more injection tools 116 installed in the well bore 102. For example, the signaling subsystem 114 may transmit hydraulic control signals, electrical control signals, and/or other types of control signals. The control signals may include control signals initiated by the injection control subsystem 111. The control signals may be reformatted, reconfigured, stored, converted, retransmitted, and/or otherwise modified as needed or desired en route between the injection control subsystem 111 (and/or another source) and the injection tools 116 (and/or another destination). The signals transmitted to the injection tools 116 may control the configuration and/or operation of the injection tools 116. For example, the signals may result in one or more valves of the injection tools 116 being opened, closed, restricted, dilated, moved, reoriented, and/or otherwise manipulated.

The signaling subsystem 114 may allow the injection control subsystem 111 to selectively control the configuration of multiple individual valves of the injection tools 116. For example, the signaling subsystem 114 may couple to multiple actuators in the injection tools 116, where each actuator controls an individual injection valve of the injection tools 116. A signal transmitted from the well bore surface 110 to the injection tools 116 through the signaling subsystem 114 may be formatted to selectively trigger one of the actuators that reconfigures the one or more valves controlled by the actuator. The signaling subsystem 114 may include one or more dedicated control lines that each communicate with an individual actuator, valve, or other type of element installed in the well bore 102. A dedicated control line may transmit control signals to an individual down-hole element to control the state of the element. The signaling subsystem 114 may include one or more shared control lines that each communicate with multiple actuators, valves, and/or other types of elements installed in the well bore 102. A shared control line may transmit control signals to multiple down hole elements to selectively control the states of each of the individual elements. A shared control line may transmit control signals to multiple down hole elements to collectively control the states of multiple elements. Utilizing shared control lines may reduce the number of control lines installed in the well bore 102.

The example injection tools 116 shown in FIG. 1 communicate fluid from the well bore 102 into the subterranean region 104. For example, the injection tools 116 may include valves, sliding sleeves, ports, and/or other features that communicate fluid from a working string installed in the well bore 102 into the subterranean region 104. The flow of fluid into the subterranean region 104 during an injection treatment may be controlled by the configuration of the injection tools 116. For example, the valves, ports, and/or other features of the injection tools 116 can be configured to control the location, rate, orientation, and/or other properties of fluid flow between the well bore 102 and the subterranean region 104. In some implementations, the well bore 102 does not include a working string, and the injection tools 116 are installed in the well bore casing. In some implementations, the injection tools 116 receive fluid from a working string installed in the well bore 102. The injection tools 116 may include multiple tools coupled by sections of tubing, pipe, or another type of conduit. The injection tools 116 may include multiple injection tools that each communicate fluid into different intervals 118 of the subterranean region 104. The injection tools may be isolated in the well bore 102 by packers or other devices installed in the well bore 102.

The state of each of the injection tools 116 corresponds to a mode of fluid communication between the well bore 102 and the subterranean region 104. For example, an injection tool in an open state allows fluid communication from the well bore 102 into the subterranean region 104 through the injection tool, while an injection tool in a closed state does not allow fluid communication from the well bore 102 into the subterranean region 104 through the injection tool. As another example, an injection tool may have multiple different states that each allow fluid communication from the well bore 102 into the subterranean region 104 through the injection tool at a different flow rate, flow orientation, or location. As such, changing the state of an injection tool modifies the mode of fluid communication from the well bore 102 into the subterranean region 104 through the injection tool. For example, closing, opening, restricting, dilating, repositioning, reorienting, an/or otherwise manipulating a flow path may modify the manner in which fluid is communicated into the subterranean region 104 during an injection treatment.

The example injection tools 116 can be remotely controlled from the well bore surface 110. In some implementations, the states of the injection tools 116 can be modified by control signals transmitted from the well surface 110. For example, the injection control subsystem 111, or another subsystem, may initiate hydraulic, electrical, and/or other types of control signals that are transmitted through the signaling subsystem 114 to the injection tools 116. A control signal may change the state of one or more of the injection tools 116. For example, a control signal may open, close, restrict, dilate, reposition, reorient, an/or otherwise manipulate a single injection valve; or a control signal may open, close, restrict, dilate, reposition, reorient, an/or otherwise manipulate multiple injection valves simultaneously or in sequence.

In some implementations, the signaling subsystem 114 transmits a control signal to multiple injection tools, and the control signal is formatted to change the state of only one or a subset of the multiple injection tools. For example, a shared electrical or hydraulic control line may transmit a control signal to multiple injection valves, and the control signal may be formatted to selectively change the state of only one (or a subset) of the injection valves. In some cases, the pressure, amplitude, frequency, duration, and/or other properties of the control signal determine which injection tool is modified by the control signal. In some cases, the pressure, amplitude, frequency, duration, and/or other properties of the control signal determine the state of the injection tool effected by the modification.

Figure 2:
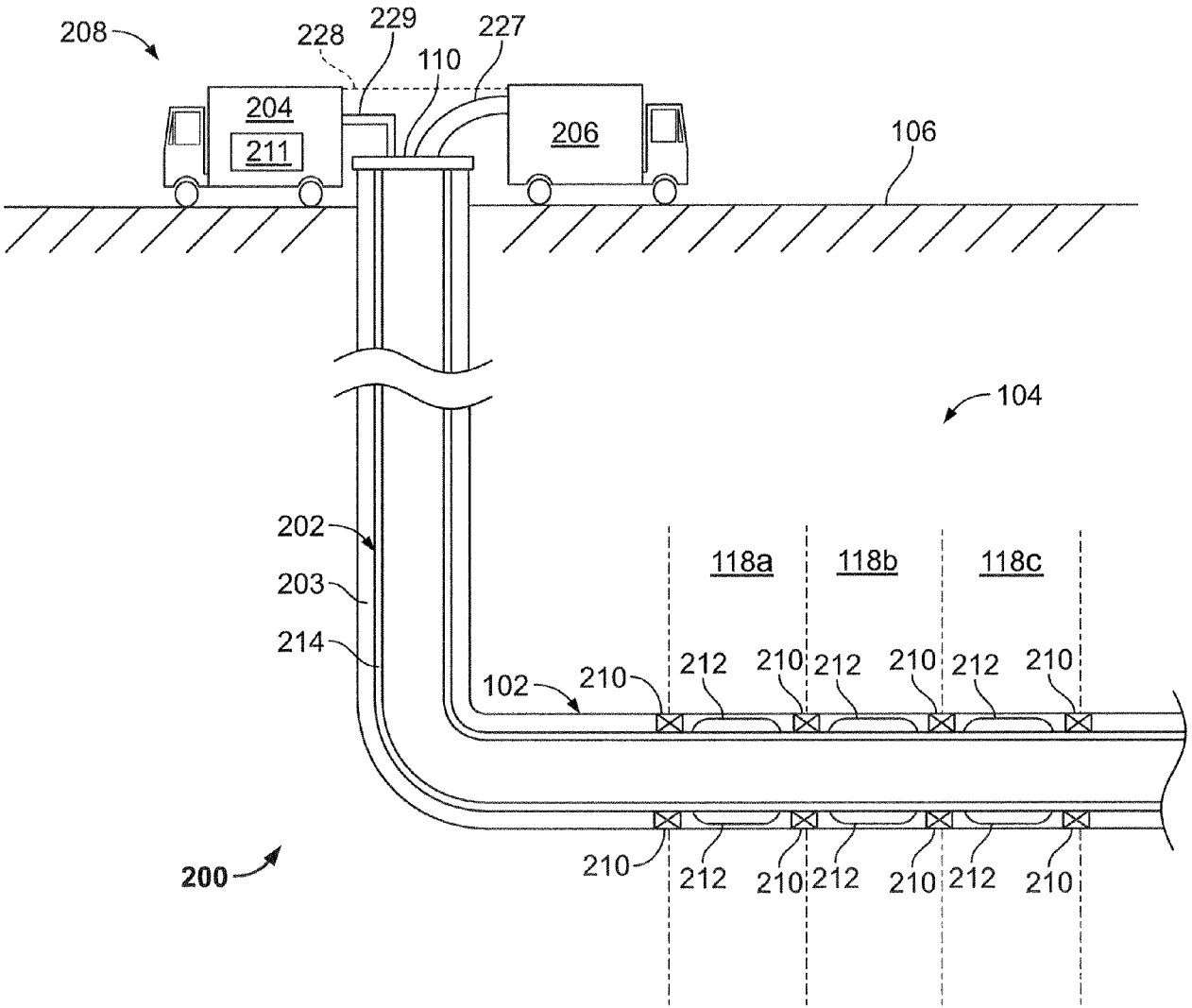
FIG. 2 is a diagram of an example well system for fracturing a subterranean formation.
Figure 3:
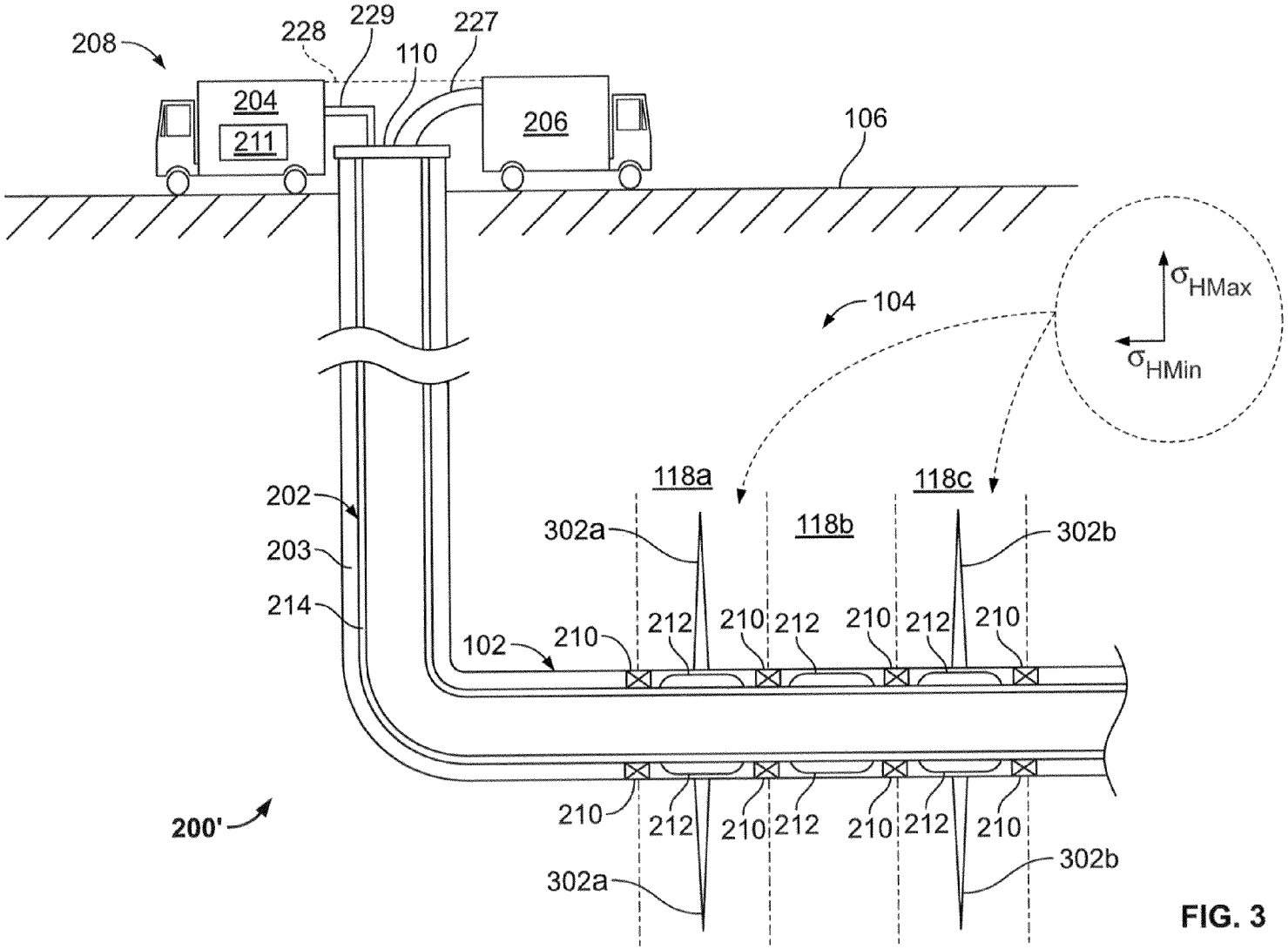
FIG. 3 is a diagram of an example well system altering stress in a subterranean formation.
Figure 4:
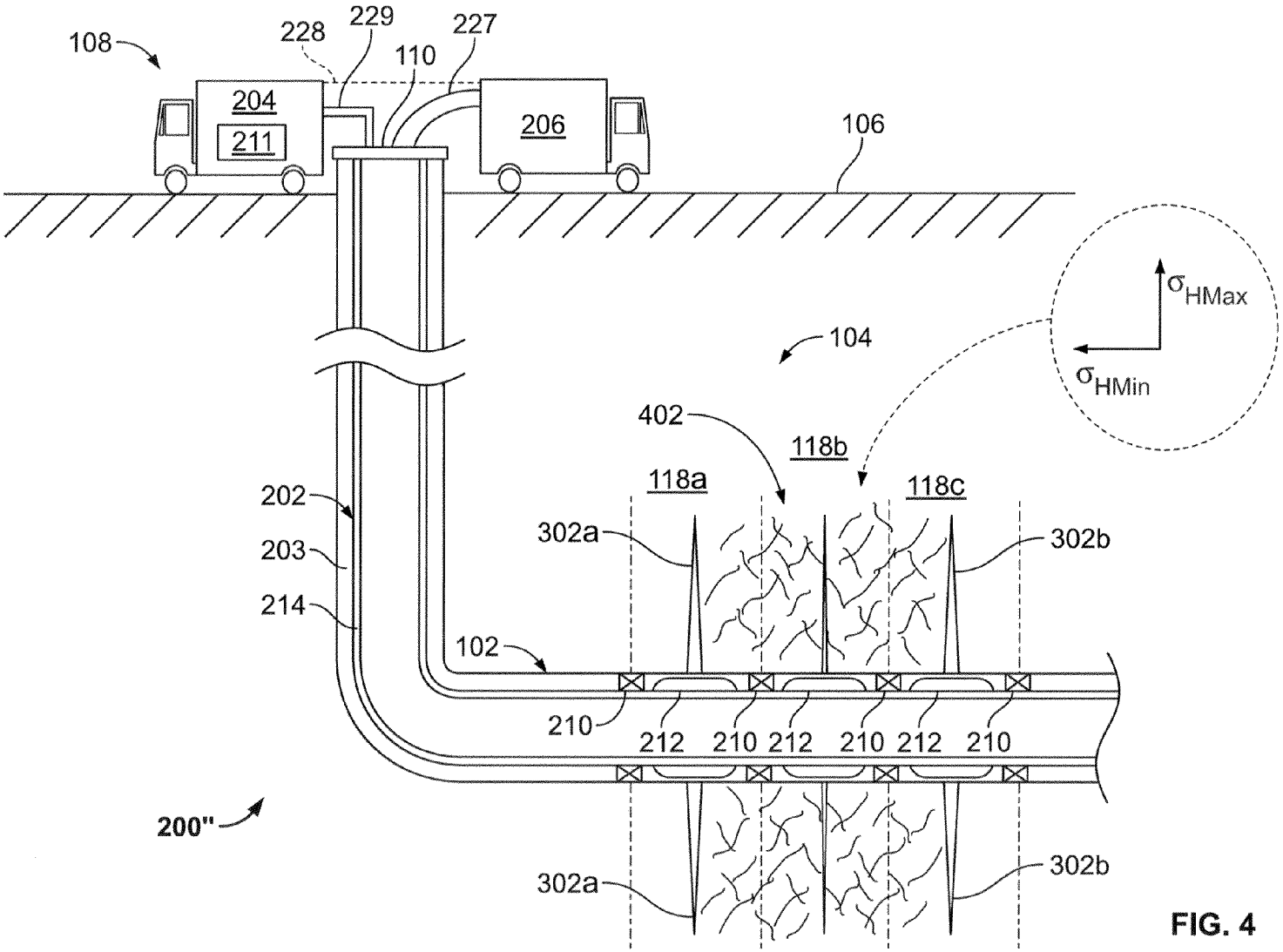
FIG. 4 is a diagram of an example well system fracturing a stress-altered subterranean formation.

FIGS. 2, 3, and 4 show an example well system during different stages of an example treatment. FIG. 2 shows the example well system 200 at an initial stage, before an injection treatment is applied to the subterranean region 104. FIG. 3 shows the example well system 200' at an intermediate stage, after an injection treatment has modified stresses in the subterranean region 104. FIG. 4 shows the example well system 200" at a subsequent stage, after an injection treatment has formed a fracture network 402 in the stress-altered portion of the subterranean region 104. Although FIGS. 2, 3, and 4 show the treatment applied to three intervals 118*a*, 118*b*, and 118*c* of the subterranean region 104, the same or a similar treatment may be applied contemporaneously or at different times in other intervals of the subterranean region 104. For example, the treatment applied in FIGS. 2, 3, and 4 may be applied at other intervals along a substantial portion of the well bore 102 and/or along the entire length of the horizontal portion of the well bore 102. The example treatment shown in FIGS. 2, 3, and 4 may constitute a portion of a stimulation treatment applied to a large portion of the subterranean region 104. For example, the operations and techniques described with respect to FIGS. 2, 3, and 4 may be repeated and/or performed in conjunction with other injection treatments applied in the intervals 118*a*, 118*b*, 118*c*, in other intervals, and/or through other well bores in the subterranean region 104. The example treatment shown in FIGS. 2, 3, and 4 may be implemented in other types of well bores (e.g., well bores at any orientation), in well systems that include multiple well bores, and/or in other contexts as appropriate.

As shown in FIG. 2, the well system 200 includes an example injection system 208. The example injection system 208 injects treatment fluid into the subterranean region 104 from the well bore 102. The injection system 208 includes instrument trucks 204, pump trucks 206, an injection control subsystem 211, conduits 202 and 227, control lines 214 and 229, packers 210, and injection tools 212. The example injection system 208 may include other features not shown in the figures. The injection system 208 may apply the injection treatments described with respect to FIGS. 1, 3, 4, and 5, as well as other injection treatments. The injection system 208 may apply injection treatments that include, for example, a mini fracture test treatment, a regular or full fracture treatment, a follow-on fracture treatment, a re-fracture treatment, a final fracture treatment and/or another type of fracture treatment. The injection treatment may inject fluid into the formation above, at or below a fracture initiation pressure for the formation, above at or below a fracture closure pressure for the formation, and/or at another fluid pressure. Fracture initiation pressure may refer to a minimum fluid injection pressure that can initiate and/or propagate fractures in the subterranean formation. Fracture closure pressure may refer to a minimum fluid injection pressure that can dilate existing fractures in the subterranean formation.

The pump trucks 206 may include mobile vehicles, immobile installations, skids, hoses, tubes, fluid tanks, fluid reservoirs, pumps, valves, mixers, and/or other suitable structures and equipment. The pump trucks 206 supply treatment fluid and/or other materials for the injection treatment. The pump trucks 206 may contain multiple different treatment fluids, proppant materials, and/or other materials for different stages of a stimulation treatment.

The pump trucks 206 communicate treatment fluids into the well bore 102 at the well bore surface 110. The treatment fluids are communicated through the well bore 102 from the well bore surface 110 by a conduit 202 installed in the well bore 102. The conduit 202 may include casing cemented to the wall of the well bore 202. In some implementations, all or a portion of the well bore 102 may be left open, without casing. The conduit 202 may include a working string, coiled tubing, sectioned pipe, and/or other types of conduit. The conduit 202 is coupled to the injection tools 212. The injection tools 212 may include valves, sliding sleeves, ports, and/or other features that communicate fluid from the conduit 202 into the subterranean region 104. The injection tools 212 may include the features of the injection tools 116 described with respect to FIG. 1. The packers 210 isolate intervals 118 of the subterranean region 104 that receive the injected materials from the injection tools 212. In the example shown, the packers 210 delineate the three intervals 118*a*, 118*b*, and 118*c*. The packers 210 may include mechanical packers, fluid inflatable packers, sand packers, fluid sensitive or fluid activated swelling packers, and/or other types of packers.

The injection system 208 includes three injection tools 212. Each injection tool 212 is installed in the well bore adjacent one of the intervals 118 to communicate fluid from the interior of the well bore 102 into the adjacent interval 118 of the subterranean region 104. In some cases, multiple injection tools 212 are installed adjacent to, and can communicate fluid into, an individual interval. A first injection tool 212 communicates fluid into a first interval 118*a*, a second injection tool 212 communicates fluid into a second interval 118*b*, and a third injection tool 212 communicates fluid into a third interval 118*c*. Each injection tool 212 can be positioned, oriented, and/or otherwise configured in the well bore 102 to control, for example, the location, rate, angle, and/or other characteristics of fluid flow into the adjacent interval 118 of the subterranean region 104. Each of the injection tools 212 is coupled to the control lines 214 to receive control signals transmitted from the well bore surface 110.

In various implementations, the control tools 212 may be controlled in a number of different manners. Each of the injection tools 212 may be sequentially and/or simultaneously reconfigured based on control signals transmitted from the well bore surface 110. As such, multiple injection tools 212 may be reconfigured at substantially the same time and/or at different times. Each of the injection tools 212 may be selectively reconfigured based on control signals transmitted from the well bore surface 110. As such, an individual injection tool 212 may be reconfigured by a control signal. In some implementations, multiple injection tools 212 may be reconfigured by a single control signal. Each of the injection tools 212 may be continuously and/or repeatedly reconfigured based on control signals transmitted from the well bore surface 110. As such, an injection tool 212 may be opened, closed, and/or otherwise reconfigured multiple times. The control signals may include pressure amplitude control signals, frequency modulated electrical control signals, digital electrical control signals, amplitude modulated electrical control signals, and/or other types of control signals transmitted by the control lines 214. The injection tools 212 may utilize FracDoor and/or DeltaStim sleeve technologies developed by Halliburton Energy Services, Inc., for example, to prevent sticking in implementations where the injection tools 212 are included in casing cemented to the wall of the well bore 102. One or more of the injection tools 212 may be implemented using the SFrac™ valve system developed by WellDynamics, Inc., available from Halliburton Energy Services, Inc.

The instrument trucks 204 may include mobile vehicles, immobile installations, and/or other suitable structures. The instrument trucks 204 include an injection control subsystem 211 that controls and/or monitors injection treatments applied by the injection system 208. The injection control subsystem 211 may include the features of the injection control subsystem 111 described with respect to FIG. 1. The communication links 228 may allow the instrument trucks 204 to communicate with the pump trucks 206, and/or other equipment at the surface 106. The communication links 228 may allow the instrument trucks 204 to communicate with sensors and/or data collection apparatus in the well system 200 (not shown). The communication links 228 may allow the instrument trucks 204 to communicate with remote systems, other well systems, equipment installed in the well bore 102 and/or other devices and equipment. The communication links 228 can include multiple uncoupled communication links and/or a network of coupled communication links. The communication links 228 may include wired and/or wireless communications systems.

The control lines 219, 214 allow the instrument trucks 204 and/or other subsystems to control the state of the injection tools 212 installed in the well bore 102. In the example shown, the control lines 219 transmit control signals from the instrument trucks 204 to the well bore surface 110, and the control lines 214 installed in the well bore 102 transmit the control signals from the well bore surface 110 to the injection tools 212. For example, the control lines 214 may include the properties of the signaling subsystem 114 described with respect to FIG. 1.

The injection system 208 may also include surface and down-hole sensors (not shown) to measure pressure, rate, temperature and/or other parameters of treatment and/or production. The injection system 208 may include pump controls and/or other types of controls for starting, stopping and/or otherwise controlling pumping as well as controls for selecting and/or otherwise controlling fluids pumped during the injection treatment. The injection control system 211 may communicate with such equipment to monitor and control the injection treatment.

As shown in the system 200' of FIG. 3, the injection system 208 has fractured the subterranean region 104. The fractures 302*a* and 302*b* may include fractures of any length, shape, geometry and/or aperture, that extend from the well bore 102 in any direction and/or orientation. Creation of the fractures 302*a* and 302*b* in the subterranean region 104 modifies stress in the subterranean region 104. For example, creation of the fractures can modify stress anisotropy in the intervals 118*a*, 118*b*, 118*c*, and elsewhere in the subterranean region 104. As a result of the modified stresses, it may be possible to create a well-connected fracture network that exposes a vast area of the reservoir, a fracture network that more readily conducts resources through the region 104, a fracture network that produces a greater volume of resources from the region 104 into the well bore 102, and/or a fracture network having other desirable qualities. For example, by fracturing in two locations as shown in FIG. 3, a subsequent injection applied between the two locations may result in a complex fracture network.

Fractures formed by a hydraulic injection tend to form along or approximately along a preferred fracture direction, which is typically related to the direction of maximum stress in the formation. In the example shown, prior to forming the two fractures 302*a* and 302*b*, the preferred fracture direction is perpendicular to the well bore 102. Formation of the fractures 302*a* and 302*b* modifies stress in the formation, and consequently also modifies the manner in which fractures form in the formation. For example, as a result of modified stress, the formation may have a less uniform preferred fracture direction. As such, modifying stress anisotropy may lead to an environment that is more favorable for generating a complex fracture network.

Stresses of varying magnitudes and orientations may be present within a subterranean formation. In some cases, stresses in a subterranean formation may be effectively simplified to three principal stresses. For example, stresses may be represented by three orthogonal stress components, which include a horizontal "x" component along an x-axis, a horizontal "y" component along a y-axis, and a vertical "z" component along a z-axis. Other coordinate systems may be used. The three principal stresses may have different or equal magnitudes. Stress anisotropy refers to a difference in magnitude between stress in a direction of maximum horizontal stress and stress in a direction of minimum horizontal stress in the formation.

In some instances, it may be assumed that the stress acting in the vertical direction is approximately equal to the weight of formation above a given location in the subterranean region 104. With respect to the stresses acting in the horizontal directions, one of the principal stresses may be of a greater magnitude than the other. In FIGS. 3 and 4, the vector labeled $\sigma_{HMax}$ indicates the magnitude of the stress in the direction of maximum horizontal stress in the indicated locations, and the vector labeled $\sigma_{HMin}$ indicates the magnitude of the stress in the direction of minimum horizontal stress in the indicated locations. As shown in FIGS. 3 and 4, the directions of minimum and maximum horizontal stress may be orthogonal. In some instances, the directions of minimum and maximum stress may be non-orthogonal. In FIGS. 3 and 4, the stress anisotropy in the indicated locations is the difference in magnitude between $\sigma_{HMax}$ and $\sigma_{HMin}$. In some implementations, $\sigma_{HMax}$, $\sigma_{HMin}$, or both may be determined by any suitable method, system, or apparatus. For example, one or more stresses may be determined by a logging run with a dipole sonic wellbore logging instrument, a wellbore breakout analysis, a fracturing analysis, a fracture pressure test, or combinations thereof.

In some cases, the presence of horizontal stress anisotropy within a subterranean region and/or within a fracturing interval may affect the manner in which fractures form in the region or interval. Highly anisotropic stresses may impede the formation of, modification of, or hydraulic connectivity to complex fracture networks. For example, the presence of significant horizontal stress anisotropy in a formation may cause fractures to open along substantially a single orientation. Because the stress in the subterranean formation is greater in an orientation parallel to $\sigma_{HMax}$ than in an orientation parallel to $\sigma_{HMin}$, a fracture in the subterranean formation may resist opening at an orientation perpendicular to $\sigma_{HMax}$. Reducing and/or altering the stress anisotropy in the subterranean formation may modify the manner in which fractures form in the subterranean formation. For example, if $\sigma_{HMax}$ and $\sigma_{HMin}$ are substantially equal in magnitude, non-parallel and/or intersecting fractures may be more likely to form in the formation, which may result in a complex fracture network.

In the example shown in FIG. 3, the fractures 302*a* and 302*b* in the intervals 118*a* and 118*c* reduce the stress anisotropy in portions of the subterranean region 104, including in the interval 118*b* between the fractures 302*a* and 302*b*. For example, the difference between the magnitudes of $\sigma_{HMax}$ and $\sigma_{HMin}$ represented in FIG. 3 is greater than the difference between the magnitudes of $\sigma_{HMax}$ and $\sigma_{HMin}$ represented in FIG. 4.

After the fractures 302*a* and 302*b* are formed, the injection tools 212 are reconfigured. To reconfigure the injection tool 212, one or more control signals are transmitted from the well bore surface 110 to the injection tools 212 by the control lines 214. The control signals may include hydraulic control signals, electrical control signals, and/or other types of control signals. The injection tools 212 are configured without well intervention. In the example shown, reconfiguring the injection tools 212 includes closing the two injection tools used to form the fractures 302*a* and 302*b* in the intervals 118*a* and 118*c*, and opening the injection tool adjacent the second interval 118*b*.

As shown in FIG. 4, the injection treatment applied to the interval 118*b* forms a fracture network 402 in the region of modified stress anisotropy. When fluid is injected into the interval 118*b* of reduced stress anisotropy (between the fractures 302*a* and 302*b*), the resulting fractures have multiple different orientations. The fracture network 402 may include natural fractures that existed in the formation before the injection treatment, or the fracture network 402 may be formed completely by the injection treatment. The fracture network 402 may have a higher surface area than the fractures 302*a* and 302*b* that were formed before the stress anisotropy was modified. The higher surface area may improve the conductivity of the formation, allowing resources to be produced from the subterranean region 104 into the well bore 102 more efficiently.

The fracture network 402 may include a complex fracture network. Complex fracture networks can include many interconnected fractures. For example, a complex fracture network may include fractures that connect to the well bore in multiple locations, fractures that extend in multiple orientations, in multiple different planes, in multiple directions, along discontinuities in rock, and/or in multiple regions of a reservoir. A complex fracture network may include an asymmetric network of fractures propagating from multiple points along one well bore and/or multiple well bores.

The injection tools 212 may be reconfigured multiple times during or after formation of the fracture network 402. For example, the injection tools may be reconfigured one or more times to further modify stress anisotropy in the subterranean region 104 and/or to modify the fracture network 402. Each time one or more of the injection tools 212 are reconfigured, control signals may be transmitted by the control lines 214 from the well bore surface 110 to select which injection tools 212 are modified and the resulting states of the modified injection tools 212.

Figure 5:
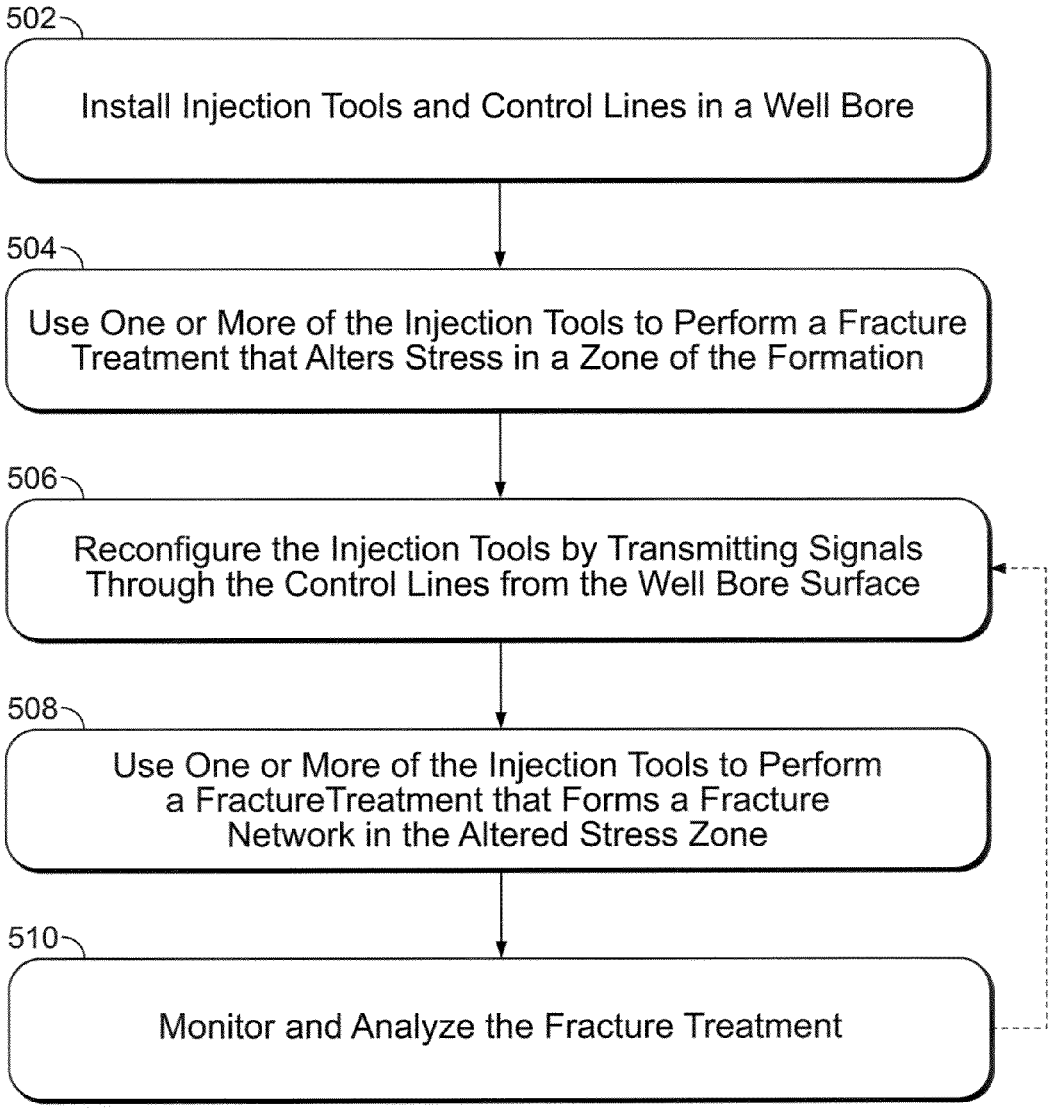
FIG. 5 is a flow chart showing an example technique for fracturing a subterranean formation.

FIG. 5 is a flow chart showing an example process 500 for fracturing a subterranean formation. All or part of the example process 500 may be implemented using the features and attributes of the example well systems shown in FIGS. 1, 2, 3, and 4 and/or other well systems. In some cases, aspects of the example process 500 may be performed in a single-well system, a multi-well system, a well system including multiple interconnected well bores, and/or in another type of well system, which may include any suitable well bore orientations. In some implementations, the example process 500 is implemented to form a fracture network in a subterranean formation that will improve resource production. For example, hydraulic fracturing from horizontal wells in shale reservoirs and/or other low permeability reservoirs may improve the production of natural gas from these low permeability reservoirs. The process 500, individual operations of the process 500, and/or groups of operations may be iterated and/or performed simultaneously to achieve a desired result. In some cases, the process 500 may include the same, additional, fewer, and/or different operations performed in the same or a different order.

At 502, injection tools and control lines are installed in a well bore. The well bore may include a horizontal well bore in a tight gas formation. A tight gas formation may include coal, shale, and/or other types of formations. The well bore may include vertical, horizontal, slant, curved, and/or other well bore orientations. Each of the injection tools may control fluid flow from the well bore into the subterranean formation based on a state of the injection tool. For example, each injection tool may have a closed state and one or more open states that allow fluid to flow into the formation at different flow rates, locations, orientations, etc. The injection tools may include a small number of injection tools located in a portion of the well bore. The injection tools may include several injection tools (e.g., 5, 10, 100, or more) installed along the length (e.g., a substantial portion of the length or the entire length) of a horizontal well bore.

The control lines may be adapted to transmit control signals from a well bore surface to each injection tool to change the state of the injection tool. For example, the control lines may transmit control signals from a source outside the well bore to the injection tools to open, close, and/or otherwise reconfigure the injection tools. The control lines may include hydraulic control lines, and the control signals may include hydraulic control signals. The control lines may include electronic control lines, and the control signals may include electronic control signals (e.g., digital electronic signals, analog electronic signals, radio frequency electronic signals, and/or other types of signals). The control lines may allow the injection tools to be reconfigured without well intervention. That is to say, the state of each individual injection tool can be selectively modified without requiring coiled tubing, a wire line ball drop mechanism, or a similar tool to open or close the injection tool. The control lines may allow the injection tools to be reconfigured during an injection treatment.

At 504, one or more of the injection tools are used to perform a fracture treatment that alters stress anisotropy in a zone of the formation. For example, multiple injection tools can inject fluids into the formation to fracture the formation, and the fractures may alter stress anisotropy in portions of the formation near the fractures. In some cases, the stress anisotropy is reduced in intervals between the fractures formed by the fracture treatment. As an example, the fracture treatment may include using a first injection tool and a third injection tool to form a first fracture and a third fracture in the subterranean formation, and forming the first fracture and forming the third fracture may alter stress anisotropy in a zone between the first fracture and the third fracture. The first and third fractures, as well as multiple other fractures that alter stress anisotropy, may be formed simultaneously or in sequence. The zone having the altered stress anisotropy may reside laterally between the fractures (e.g., horizontally between the first fracture and the third fracture).

At 506, the injection tools are reconfigured by transmitting signals through the control lines from the well bore surface. Continuing the example above, reconfiguring the injection tools may include using the control lines to transmit one or more control signals from the well bore surface to the first injection tool and the third injection tool after formation of the first fracture and the third fracture. The injection tools may include valves that communicate fluid into the subterranean formation, and reconfiguring an injection tool may include selectively opening or closing at least one of the valves without well intervention. For example, the control signals may close injection valves that were used to form the fractures that altered stress anisotropy, and/or the control signals may open other injection valves for performing a subsequent fracture treatment.

At 508, one or more of the injection tools are used to perform a fracture treatment that forms a fracture network in the altered stress zone of the subterranean formation. Continuing the example above, forming the fracture network may include using a second injection tool to form a fracture network in the zone having the altered stress anisotropy between the first fracture and the third fracture. In some cases, multiple injection tools may be used to form the fracture network along a substantial portion or the entire length of a horizontal well bore.

At 510, the fracture treatment applied to the altered stress zone is monitored and analyzed. Continuing the example above, the subterranean formation may be monitored and analyzed while using the second injection tool and/or additional fracture tools to form the fracture network. In some implementations, the use of real time fracture mapping combined with fracture pressure interpretation can be used to provide information regarding the fracture growth so that alternations in the treatment design and execution can be made to achieve the desired results. For example, monitoring the fracture treatment may include collecting microseismic data, measuring earth and/or well bore surface orientations with tiltmeters, and/or monitoring flow rates, flow pressures, and/or other properties of the fluid injection. Fracture mapping techniques may identify the locations of fractures, for example, based on the locations and magnitudes of microseismic events in the subterranean formation. Pressure mapping techniques may identify properties of fractures, for example, based on fluid pressures measured during the fracture treatment and the manner in which those pressures change over time.

One or more of the operations of the process 500 may be iterated and/or re-iterated based on the analysis of the fracture treatment. For example, the control lines may be used multiple subsequent times to change the states of the injection tools by transmitting additional control signals from the well bore surface. Continuing the example above, the first injection tool, the second injection tool, the third injection tool, and/or another injection tool may be reconfigured while using the second injection tool (and/or another injection tool) to form the fracture network. The reconfiguring of the injection tools may be based on measurement and analysis of the fracture treatment. The analysis of the fracture treatment and reconfiguration of the fracture tools may be performed in real-time. That is to say, the fracture treatment system may be reconfigured and/or the fracture treatment plan may be updated based on information measured and/or analyzed while the fracture treatment is in progress.

In some cases, iteration of one or more of the operations of the process 500 includes sending multiple successive control signals from the well bore surface through the control lines to the injection tools to select multiple successive states for the injection tools. Fluid can be injected into the subterranean formation through one or more of the injection tools in each of the successive states to create the fracture network in the subterranean formation. Each of the injection tools may be reconfigured multiple times, at any given time, during the fracture treatment.

In the present disclosure, "each" refers to each of multiple items or operations in a group, and may include a subset of the items or operations in the group and/or all of the items or operations in the group. In the present disclosure, the term "based on" indicates that an item or operation is based at least in part on one or more other items or operations—and may be based exclusively, partially, primarily, secondarily, directly, or indirectly on the one or more other items or operations.

A number of embodiments of the invention have been described. Nevertheless, it will be understood that various modifications may be made without departing from the spirit and scope of the invention. Accordingly, other embodiments are within the scope of the following claims.

The invention claimed is:

1. A method of fracturing a subterranean formation, the method comprising:

installing a plurality of injection tools and a signaling subsystem in a well bore in a subterranean formation, each of the injection tools controlling fluid flow from the well bore into the subterranean formation based on a state of the injection tool, the signaling subsystem adapted to transmit control signals from a well bore surface to each injection tool to change the state of the injection tool, the plurality of injection tools comprising a first injection tool, a second injection tool, and a third injection tool;

using the first injection tool and the third injection tool to form a first fracture and a third fracture in the subterranean formation, wherein forming the first fracture and forming the third fracture alters a stress anisotropy in a zone between the first fracture and the third fracture;

using the signaling subsystem to change the states of at least one of the plurality of injection tools by transmitting one or more control signals from the well bore surface after formation of the first fracture and the third fracture; and using the second injection tool to form a fracture network in the zone having the altered stress anisotropy between the first fracture and the third fracture.

2. The method of claim 1, further comprising:

measuring properties of the subterranean formation while using the second injection tool to form the fracture network; and using the signaling subsystem to change the states of at least one of the plurality of injection tools by transmitting one or more additional control signals from the well bore surface while using the second injection tool to form the fracture network, the one or more additional control signals based on the measured properties.

3. The method of claim 1, wherein each of the plurality of injection tools includes an injection valve that controls the fluid flow from the well bore into the subterranean formation, and using the signaling subsystem to change the states of at least one of the plurality of injection tools comprises selectively opening or closing at least one of the plurality of valves without well intervention.

4. The method of claim 3, wherein selectively opening or closing at least one of the plurality of valves comprises:

closing a first fluid injection valve of the first injection tool after formation of the first fracture;

closing a third fluid injection valve of the third injection tool after formation of the third fracture; and opening a second fluid injection valve of the second injection tool.

5. The method of claim 1, wherein using the first injection tool and the third injection tool to form the first fracture and the third fracture comprises simultaneously forming the first fracture and the third fracture.

6. The method of claim 1, wherein the signaling subsystem comprises a plurality of hydraulic control lines, and the one or more control signals comprises one or more hydraulic control signals transmitted from the well bore surface.

7. The method of claim 1, wherein the signaling subsystem comprises a plurality of electrical control lines, and the one or more control signals comprises one or more electronic control signals transmitted from the well bore surface.

8. The method of claim 1, wherein the plurality of injection tools are installed in a horizontal well bore, and the zone having the altered stress anisotropy resides laterally between the first fracture and the third fracture.

9. The method of claim 1, wherein the subterranean formation comprises a tight gas reservoir.

10. A system for fracturing a subterranean formation, the system comprising:

a plurality of injection tools installed in a well bore in a subterranean formation, each of the plurality of injection tools controlling a flow of fluid from the well bore into an interval of the subterranean formation based on a state of the injection tool, the plurality of injection tools comprising a first injection tool controlling a first flow of fluid into a first interval, a second injection tool controlling a second flow of fluid into a second interval, and a third injection tool controlling a third flow of fluid into a third interval, the second injection tool installed in the well bore between the first injection tool and the third injection tool; and an injection control subsystem that controls the states of the plurality of injection tools by sending control signals from the well bore surface to the plurality of injection tools through a signaling subsystem installed in the well bore, each of the control signals changing the state of one of the injection tools to modify the flow controlled by the injection tool, the subterranean formation comprising:

a zone of altered stress anisotropy, the stress anisotropy of the zone altered by the first flow of fluid into the first interval and the third flow of fluid into the third interval; and a fracture network in the zone of altered stress anisotropy, the fracture network formed by the second flow of fluid into the second interval.

11. The system of claim 10, the system further comprising a data analysis subsystem that identifies properties of the subterranean formation based on data received from a measurement subsystem during a fracture treatment, the control signals transmitted during the fracture treatment based on the properties identified by the data analysis subsystem.

12. The system of claim 11, wherein the measurement subsystem comprises a plurality of microseismic sensors that detect microseismic events in the subterranean formation, and the data analysis subsystem comprises a fracture mapping subsystem that identifies locations of fractures in the subterranean formation based on data received from the plurality of microseismic sensors.

13. The system of claim 11, wherein the measurement subsystem comprises a plurality of tiltmeters installed at surfaces about the subterranean formation to detect orientations of the surfaces, and the data analysis subsystem comprises a fracture mapping subsystem that identifies locations of fractures in the subterranean formation based on data received from the plurality of tiltmeters.

14. The system of claim 11, wherein the measurement subsystem comprises a plurality of pressure sensors that detect pressures of fluids in the well bore, and the data analysis subsystem comprises a pressure interpretation subsystem that identifies properties of fluid flow in the subterranean formation based on data received from the plurality of pressure sensors.

15. A method of fracturing a subterranean formation, the method comprising:

altering stresses in a subterranean formation adjacent a horizontal well bore by creating a plurality of fractures in the subterranean formation along the horizontal well bore;

sending a plurality of control signals from a well bore surface through a signaling subsystem in the horizontal well bore to a plurality of injection tools installed in the horizontal well bore to select a plurality of states for the plurality of injection tools; and injecting fluid into the stress-altered subterranean formation through one or more of the plurality of injection tools in each of the states to create a fracture network in the subterranean formation.

16. The method of claim 15, wherein the plurality of states comprise a first state and a plurality of additional states after the first state, one or more of the additional states based on data received from the subterranean formation during the injection of fluid through the plurality of injection tools in the first state.

17. The method of claim 15, wherein:

altering the stresses in the subterranean formation comprises:

injecting fluid from the horizontal well bore into a first interval of the subterranean formation through a first injection tool; and injecting fluid from the horizontal well bore into a third interval of the subterranean formation through a third injection tool;

selecting a first state of the plurality of states comprises:

closing the first injection tool based on a first control signal transmitted from the well bore surface through the signaling subsystem;

closing the third injection tool based on a third control signal transmitted from the well bore surface through the signaling subsystem; and opening a second injection tool based on a second control signal transmitted from the well bore surface through the signaling subsystem; and injecting fluid into the stress-altered subterranean formation comprises:

injecting fluid from the horizontal well bore into a second interval of the subterranean formation through the second injection tool to fracture at least a portion of the second interval the subterranean formation, the second interval residing between the first interval and the third interval.

18. The method of claim 17, wherein injecting fluid into the first interval and injecting fluid into the third interval comprises simultaneously injecting fluid into the first interval and the third interval.

19. The method of claim 17, wherein selecting a second state of the plurality of states comprises opening at least one additional injection tool installed in the horizontal well bore based on a fourth signal transmitted from the well bore surface through the signaling subsystem during the injection through the second injection tool, the at least one additional injection tool comprising at least one of the first injection tool, the third injection tool, or a fourth injection tool that permits fluid flow from the horizontal well bore into the subterranean formation.

20. The method of claim 17, wherein selecting a third state of the plurality of states comprises closing the at least one additional injection tool based on a fifth signal transmitted from the well bore surface through the signaling subsystem during the injection through the second injection tool.

* * * * *